United States Patent [19]

van der Wal

[11] 4,366,021

[45] Dec. 28, 1982

[54] DEVICES FOR APPLYING A THERMOPLASTIC TAPE AROUND AN OBJECT OR A STACK OF OBJECTS

[75] Inventor: Auke van der Wal, Oss, Netherlands

[73] Assignee: Vereenigde Metaaalverpakking en Hechtdraad Industrie B.V. MVM-ENDRA, Oss, Netherlands

[21] Appl. No.: 248,496

[22] Filed: Mar. 27, 1981

[51] Int. Cl.[3] ..... B29C 17/04

[52] U.S. Cl. ..... 156/468; 53/228; 53/466; 100/33 PB; 156/494; 156/522

[58] Field of Search ..... 156/443, 468, 488, 522, 156/494; 53/399, 466, 228; 100/33 PB

[56] References Cited

U.S. PATENT DOCUMENTS

| | | | |
|---|---|---|---|
| 3,564,810 | 2/1971 | Galetti et al. | 53/466 |
| 3,942,298 | 3/1976 | Matzinger et al. | 53/228 |
| 3,950,203 | 4/1976 | van de Wal | 156/213 |
| 4,209,958 | 7/1980 | Bailey | 53/228 |

*Primary Examiner*—Caleb Weston

*Attorney, Agent, or Firm*—Diller, Ramik & Wight

[57] ABSTRACT

A device for applying a tape around one or more objects, in which first a tape consisting of two tapes welded together is passed in U-shaped fashion around the object or objects, thereafter the two tape portions extending beyond the object or objects are moved towards one another by means of movable tape strainers; thereupon one tape portion is melted through, bent over and superficially melted by a heating element forming part of a tape bending-over member; then the other tape portion is melted through to form tape end portions and superficially melted by said heating element and finally the latter tape end portions are bent over and welded to the former tape end portions in pairs by a second tape bending-over member; the two bending-over members so co-operating as to make the two weld joints between the respective tape end portions to lie in the plane of tape of which they form part.

10 Claims, 9 Drawing Figures

Figure 2:
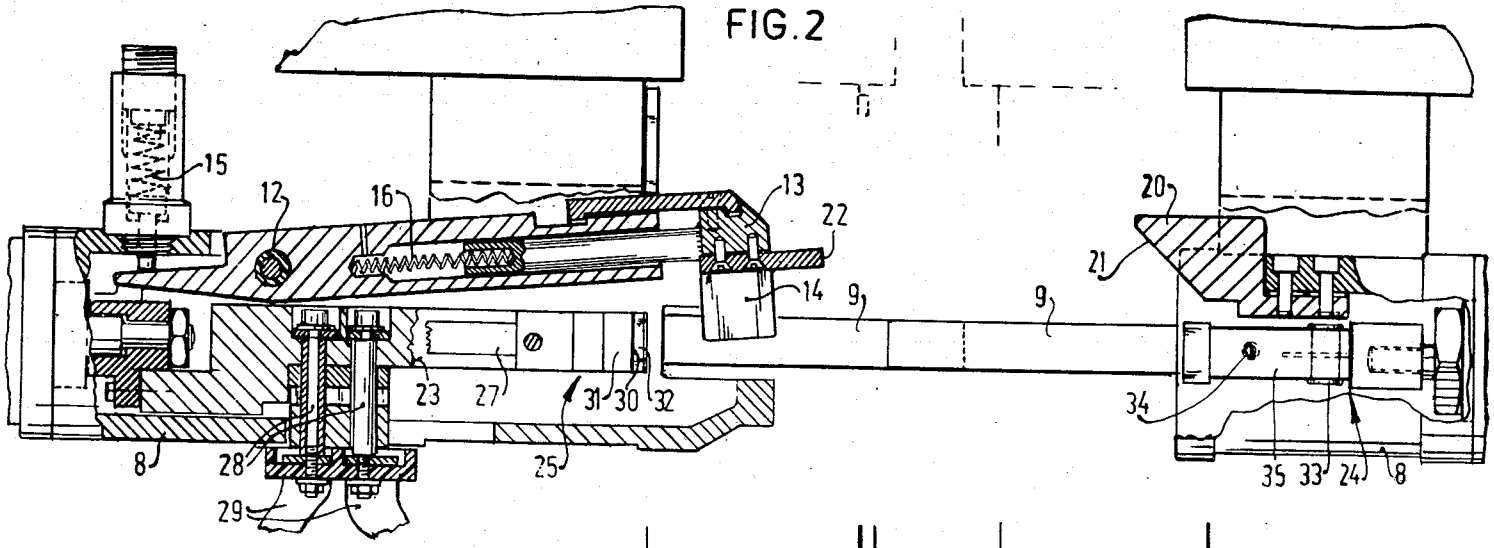

FIG.1
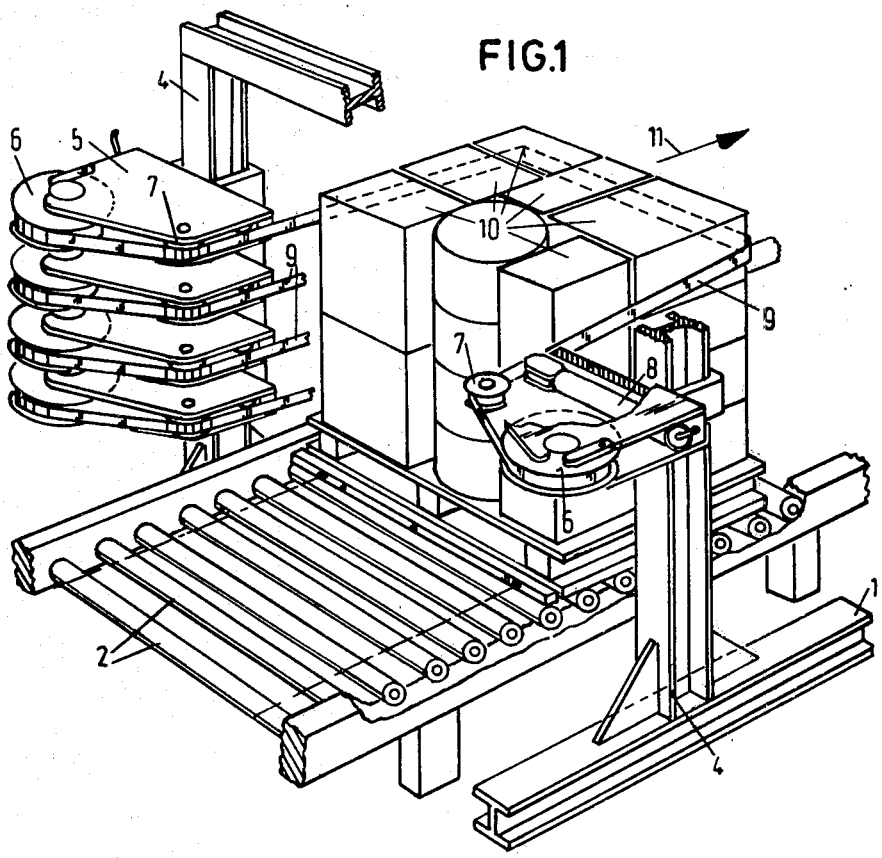
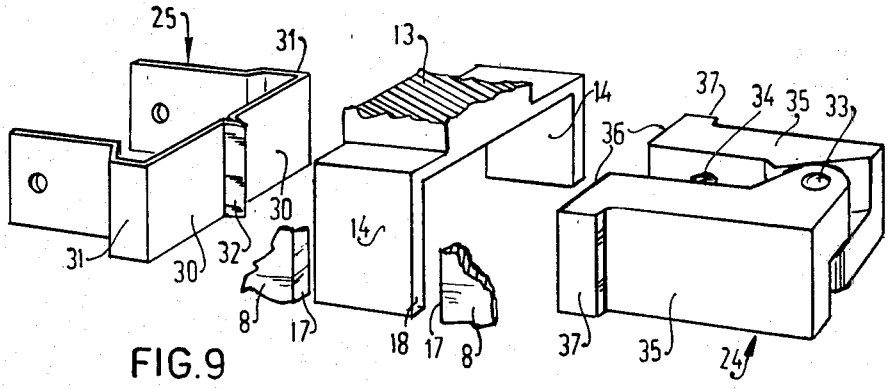
FIG.9

DEVICES FOR APPLYING A THERMOPLASTIC TAPE AROUND AN OBJECT OR A STACK OF OBJECTS

The invention relates to a device for applying a thermoplastic tape around an object or a stack of objects, said device comprising at least one set of two tape supply reels arranged at a distance from each other, two tape strainers arranged on the same side of the supply reels and mounted for movement towards and from each other in order to force towards each other the portions of a tape extending between an object or a stack of objects and the supply reels and having already been applied in the form of a substantially U-shaped loop around a portion of the circumference of the object or stack of objects, said tape consisting of two previously interconnected pieces, each of which emanates from a respective one of said two supply reels, two clamping faces formed on the free end face of each tape strainer and spaced apart transversely to the direction of movement of the tape strainers, a stop member having two side plates which are adapted to be inserted between the two tape strainers and are each bounded by a clamping face co-operating with a clamping face of one tape strainer, a clamping face co-operating with a clamping face of the other tape strainer and a supporting face which extends between said clamping faces in the direction of movement of the tape strainers and faces the other side plate, two tape bending-over members mounted on respective ones of the tape strainers between the clamping faces thereof for movement in the direction of movement of the tapes strainers and being adapted to be moved one after the other from the respective tape strainer towards the other tape strainer with side faces brushing the supporting faces of the stop member, a tape severing member provided on the first operative tape bending-over member midway between the clamping faces of the respective tape strainer, a heating element also provided on said first operative tape bending-over member and means for moving the tape strainers, the stop member, the tape severing member and the tape bending-over members in a given order of succession.

A device of this kind is known from the NL-patent specification No. 156357 and the patent specifications Nos. U.S. Pat. No. 3,950,203; UK Pat. No. 1 502 822; DE Pat. No. 2513668 which substantially correspond with the said Dutch specification.

The invention has for its object to adapt the known device in a simple manner for applying a thermoplastic tape, e.g. a thermoplastic tape reinforced by glass fibres, around an object or a stack of objects and welding the end portions of the tape together. This is achieved in that the tape severing member is a heatable member adapted to melt the tape locally through and the heating element is constructed for heating the head face, the melting-through member and the brushing faces of the first operative tape bending-over member and it is further achieved in that the head faces of the two tape bending-over members are so formed and adapted to each other as to ensure that, after the two pieces of tape have been clamped between the tape strainers and the stop member and, during the movement of the first operative tape bending-over member towards the other tape bending-over member, the first piece of tape has been melted through in two halves, thereupon the thereby produced separated tape end portions have been bent over, forced against the supporting faces of the stop member and superficially melted on their inner sides and thereafter also the second piece of tape has been melted through in two halves, the thereby produced separated end portions of the second piece of tape are lightly clamped between the head faces of the two tape bending-over members and thereby superficially melted on their outer sides, so that, during the next movement of both tape bending-over members towards the first tape strainer, said latter tape end portions are pulled out of the space left between the head faces of the two tape bending-over members and forced onto the end portions of the first piece of tape by the brushing faces of the second tape bending-over member and the thereby obtained overlapping tape end portions are welded together. In essence the device constructed in acoordance with the invention differs from the device described by way of example in the cited patent specifications in that the means for applying glue between the tape end portions to be interconnected are omitted but the heating element meant to dry the adhesive joint is maintained.

A very simple construction of the tape applying device is obtained, when the active head face and the active brushing faces of the first operative tape bending-over member are formed by the outer surface of a the heating element constituting a strip of electrical resistance material, said strip being bent over said tape bending-over member, electrically insulated in respect thereof and adapted to be connected to an electric power source. Advantageously, the strip of electrical resistance material may have midway between the brushing faces a cross rib protruding from the head face and forming the melting-through member. The simplest construction is obtained, when the strip of electrical resistance material has in the place in the melting-through member a cross rib formed by an outward bend of the strip, said bend having a U-or V-shaped cross sectional area. In that case the head face, the melting-through member and the brushing faces, consequently, all active parts of the first operative tape bending-over member are constituted by one single bent strip of electrical resistance material. This makes it possible to use for tape of any possible width and for each voltage of the power source a suitable heating element or heat-strip.

Figure 3:
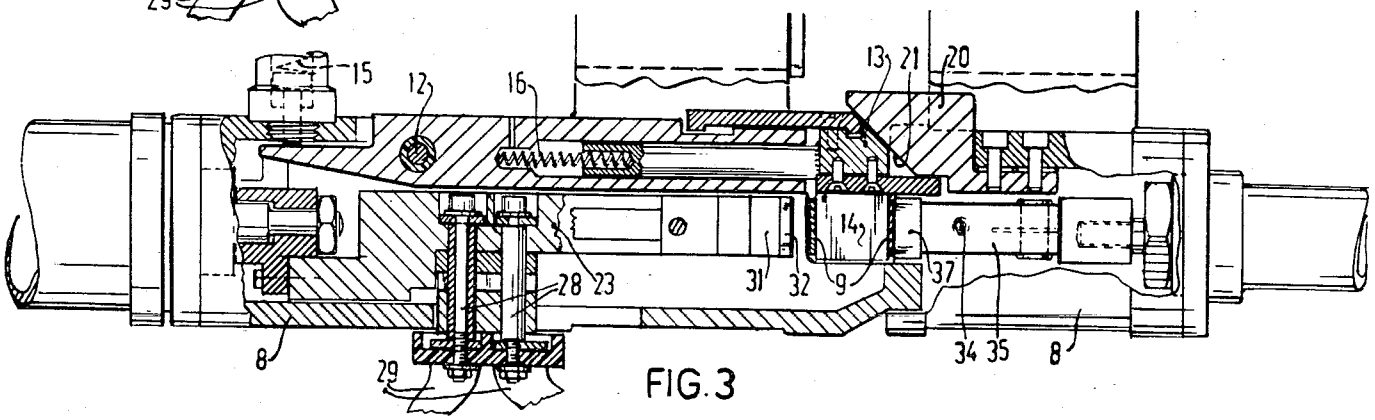

The invention will be described by way of example with reference to the accompanying drawings, in which:

FIG. 1 is a perspective view of a multiple taping device constructed in accordance with the invention, FIG. 2 is partially a front view, partially a longitudinal sectional view of the active end parts of two co-operating tape strainers employed in said device, when they are still at a distance from each other, FIG. 3 is partially a front view, partially a longitudinal sectional view of the two co-operating tape stainers shown in FIG. 2, after they have approached each other as closely as possible, FIGS. 4, 5, 6, 7, 8 are diagrammatical plan views of different positions of the means to bend over and to interconnect the tape end portions obtained after the melting-through of two clamped tape portions and FIG. 9 is an enlarged exploded perspective view of co-operating parts employed in the device as shown in FIGS. 1-8.

Refering to the drawings, reference 1 designates a stationary base frame, 2 a roller track for conveying pallets 3, and 4 two columns mounted on the base frame 1, one on each side of the roller track 2, and adjustable in the height direction. Each column 4 supports four taping devices 5, some of which are omitted in FIG. 1. Each taping device 5 comprises a holder which is slidably and fixably arranged on one of the columns 4 and holds a tape supply reel 6, a guide roller 7 and a composite tape strainer 8. Every taping device 5 of one column 4 co-operates with a taping device of the other column. The two co-operating taping devices are located at the same height above the roller track 2.

Initially, in a manner not shown in detail, a tape is stretched between each pair of supply reels 6, this tape being formed by the tape 9 emanating from the supply reels 6 of the respective pair and having their ends interconnected. When a pallet 3 with an object or a stack of objects 10 is displaced in the direction of the arrow 11 in FIG. 1 along the roller track 2, the interconnected tape portions 9 are applied in the form of a U around the stack of objects 10 in the manner shown in that Figure. The supply reels can rotate only against a heavy frictional force so that the tape portions 9 are kept taut.

When the pallet 3 with the objects 10 has arrived at the position shown in FIG. 1, the pallet 3 is retained for a short time and the tape strainers 8 are moved towards one another. Thus the tape portions 9 extending between the stack of objects 10 and the supply reels 6 approach one another along said stack.

The head of the left hand tape strainer is provided with a stop member 13 with two side plates 14 which is mounted for swinging about a horizontal transverse pivot 12 and is held, during the active stroke of said tape strainer, in upwards slanting position out of reach of the tape portions 9 by a spring 15 (FIGS. 2, 3). The stop member 13 is resiliently connected with the head of said tape strainer by means of a compression spring 16 which is radially directed in respect of the pivot 12.

From the diagrammatical FIGS. 4–8 it appears that the tape strainers 8 are each provided with two clamping faces 17 spaced horizontally apart and the side plates 14 of the stop member 13 have clamping faces 18 which co-operate with the clamping faces 17. Furthermore these side plates are bounded on their sides facing each other by supporting faces 19. During movement of the tape strainers towards one another each tape portion 9 is stretched between and over the two clamping faces 17 of the respective tape strainer.

The right hand tape strainer is provided with a block 20 having a bevelled guiding face 21 and attached to the stop member 13 is a projection 22 adapted to co-operate with said guiding face. When the tape strainers approach each other the stop member 13 is pushed downwards against the force of the spring 15 by the guiding face 21 and the projection 22 and it is then placed between the tape strainers 8 at some distance from the tape portions 9 which are stretched between the clamping faces 17 of the tape strainers. When thereafter the tape strainers continue to approach each other the stop member 13, 14 is pushed against the force of the spring 16 towards the left-hand tape strainer and finally the tape portions 9 are clamped tightly between the clamping faces 17 and 18, each one in two spaced places. This position is diagrammatically shown in FIG. 4. In that positon the projection 22 engages a recess on the lower side of the block 20, so that the stop member 13, 14 is locked against upward displacement (FIG. 3).

Mounted in the head of each one of the two tape strainers is a tape bending-over member 23, 24 which is adapted to be displaced in the direction of movement of the tape strainers. The bending-over member 23 of the left hand tape strainer consists of a block, over the head face and the free end portions of the sides of which a bow-shaped strip 25 of electrical resistance material is placed. This strip is attached to the block of the tape bending-over member 23 through a plate of insulating material 26 (FIGS. 4–9). The strip 25 forms a heating element and can be inserted into an external electric circuit 29 through insulated conductors 27 and bolts 28 (FIGS. 2,3). The resistance strip 25 constitutes the active head face 30 and the brushing faces 31 provided on the sides of the tape bending-over member 23 (FIG. 9). In the middle of its head face 30 the resistance strip 25 is so bent outwards as to form a vertical cross rib 32 having a U- or V-shaped cross sectional area. This cross rib constitutes a melting-through member for melting the tape portions 9 held between the tape strainers 8 and the stop member 13, 14 midway between the clamping places.

The righthand tape bending-over member 24 consists generally of two brushing and pressing blocks 35 which are pivotally mounted about a vertical pivot 33 and loaded by a compression spring 34. The head faces 36 of said blocks 35 are adapted to the head face 30 of the heating element 25 and co-operate with the latter and the free end portions of the side faces thereof constitute the brushing and press-on faces 37 of said tape bending-over member (FIG. 9).

Figure 4:
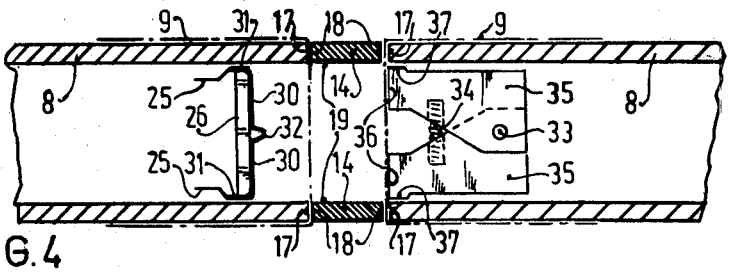
Figure 5:
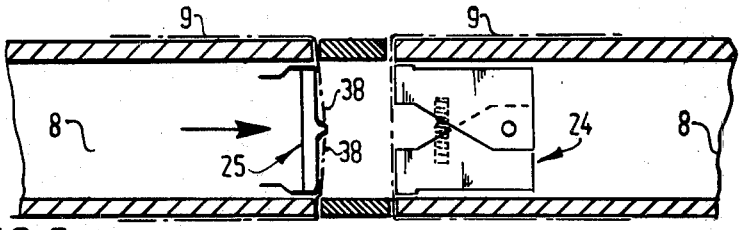

In the position illustrated in FIG. 4 the tape portions 9 are clamped between the clamping faces 17 of the tape strainers 8 and the clamping faces 18 of the stop member 13, 14 and the two tape bending-over members 23 and 24 are retracted in respect of the tape strainers as far as possible. The head faces 36 of the block 35 of the right-hand tape bending-over member 24 lie flush with the clamping faces 17 of the right-hand tape strainer, so that the right-hand tape portion 9 is in contact with the head faces 36.

Figure 6:
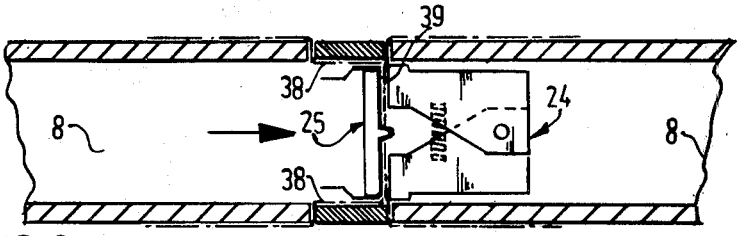
Figure 7:
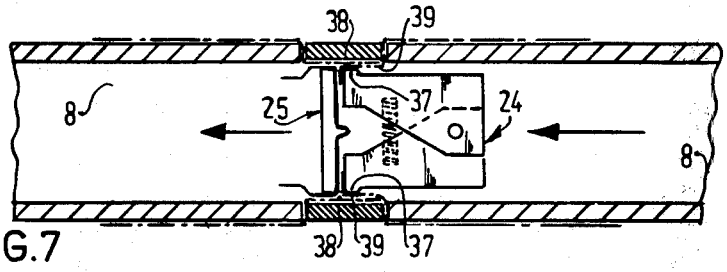
Figure 8:
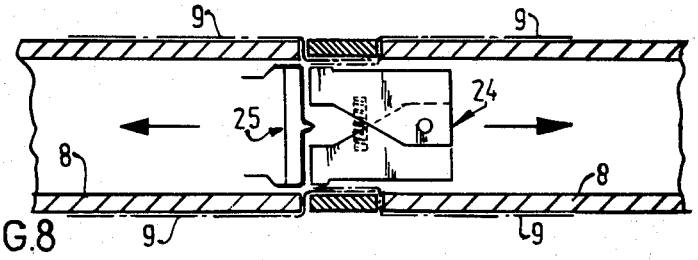

After the position shown in FIG. 4 has been reached the left-hand tape bending-over member 23 with its heating strip 25 is moved to the right. This results in that first the left-hand tape portion 9 is melted through in the middle by the melting-through rib 32 (FIG. 5), thereupon the thus formed separated tape end portions 38 are bent by the hot brushing faces 31, forced against the supporting faces 19 of the side plates 14 of the stop member 13 and on their inner sides superficially melted, and thereafter the right-hand tape portion 9 is melted through and the formed separated tape end portions 39 are lightly gripped between the head face 30 of the heating strip 25 and the head faces 36 of the blocks 35, so that these latter tape end portions 39 are superficially melted on their outer sides (FIG. 6).

Upon that the two tape bending-over members 23 and 24 are moved together to the left (FIG. 7), so that the tape end portions 39 are bent by the brushing faces 37 of the blocks 35 and pressed with their melted faces onto the melted faces of the tape end portions 38, consequently, welded thereto. After the end condition shown in FIG. 8 has been reached, the tape bending-over member 23 with its heating strip 25 is retracted further to the left and the bending-over member 24 with its blocks 35 is moved to the right, until the condition shown in FIG. 4 has been restored.

Finally the tape strainers with their accessories are moved from each other towards their rest positions out of reach of the track of the objects to be taped and the